US010273756B2

(12) United States Patent
Wong

(10) Patent No.: US 10,273,756 B2
(45) Date of Patent: Apr. 30, 2019

(54) MANAGING ROTATIONAL INFORMATION ON A DRILL STRING

(71) Applicant: Halliburton Energy Services, Inc., Houston, TX (US)

(72) Inventor: David Yan Lap Wong, Edmonton (CA)

(73) Assignee: HALLIBURTON ENERGY SERVICES, Houston, TX (US)

( * ) Notice: Subject to any disclaimer, the term of this patent is extended or adjusted under 35 U.S.C. 154(b) by 793 days.

(21) Appl. No.: 14/485,905

(22) Filed: Sep. 15, 2014

(65) Prior Publication Data

US 2016/0076361 A1 Mar. 17, 2016

(51) Int. Cl.

| | |
|---|---|
| ***E21B 7/06*** | (2006.01) |
| ***E21B 47/12*** | (2012.01) |
| ***E21B 41/00*** | (2006.01) |

(52) U.S. Cl.

CPC ..... *E21B 7/06* (2013.01); *E21B 7/062* (2013.01); *E21B 7/067* (2013.01); *E21B 7/068* (2013.01); *E21B 41/0092* (2013.01); *E21B 47/12* (2013.01)

(58) Field of Classification Search

CPC ... E21B 7/04; E21B 7/046; E21B 7/06; E21B 7/062; E21B 7/068; E21B 41/0092; E21B 47/006

See application file for complete search history.

(56) References Cited

U.S. PATENT DOCUMENTS

| | | | | |
|---|---|---|---|---|
| 3,967,680 | A | 7/1976 | Jeter | |
| 4,013,945 | A | 3/1977 | Grosso | |
| 4,647,853 | A | 3/1987 | Cobern | |
| 4,839,644 | A | 6/1989 | Safinya et al. | |
| 5,850,624 | A | 12/1998 | Gard et al. | |
| 6,206,108 | B1 * | 3/2001 | MacDonald | E21B 44/00 175/24 |
| 6,267,185 | B1 | 7/2001 | Mougel et al. | |
| 6,443,242 | B1 * | 9/2002 | Newman | E21B 44/00 166/381 |
| 7,095,232 | B2 | 8/2006 | Haber et al. | |
| 7,359,844 | B2 | 4/2008 | Sung et al. | |
| 7,866,415 | B2 * | 1/2011 | Peters | E21B 7/06 175/61 |
| 8,525,690 | B2 | 9/2013 | Puro et al. | |

(Continued)

FOREIGN PATENT DOCUMENTS

| | | |
|---|---|---|
| WO | 2012175658 | 12/2012 |

OTHER PUBLICATIONS

OnePetro, "Analysis of the Stick-Slip Phenomenon Using Downhole Drillstring Rotation Data", Copyright 1999, SPE/IADC Drilling Conference, https://www.onepetro.org/ , p. 1.

*Primary Examiner* — David J Bagnell
*Assistant Examiner* — Tara E Schimpf
(74) *Attorney, Agent, or Firm* — Polsinelli PC

(57) ABSTRACT

A method for sharing information between components of a subterranean drill string. The method can include receiving, at a controller, data representative of a detected rotational characteristic of a drill string sensed at a first location on the drill string. Further, the method includes calculating, at the controller, a rotational characteristic corresponding to a second location on the drill string based, at least in part, on the detected data, and transmitting data representative of the calculated rotational characteristic to the second location.

29 Claims, 10 Drawing Sheets

(56) References Cited

U.S. PATENT DOCUMENTS

| | | | | |
|---|---|---|---|---|
| 2008/0234939 | A1* | 9/2008 | Foot | E21B 43/00 702/12 |
| 2009/0050370 | A1* | 2/2009 | Peters | E21B 7/06 175/45 |
| 2011/0172976 | A1 | 7/2011 | Budiman et al. | |
| 2011/0174541 | A1 | 7/2011 | Strachan et al. | |
| 2013/0226461 | A1 | 8/2013 | Yu et al. | |

* cited by examiner

MANAGING ROTATIONAL INFORMATION ON A DRILL STRING

FIELD

The present disclosure relates generally to subterranean drilling systems. More particularly, the present application relates to sharing rotational information, such as drill string revolution speeds, between different locations along the length of a drill string.

BACKGROUND

Rotational characteristics of a drill string are important to many operations undertaken during the drilling process of a subterranean well. One example is drill string rotation rate which can vary along the length of the drill string due to, among other things, the natural flex of their materials of construction, drag caused by contact with sides of the wellbore, extreme downhole conditions and resistance to rotation experienced at the drill bit. Many tools along the drill string require rotational information in order to carry out their particular purposes. Accordingly, sensors are often provided locally, within a tool, or within the immediate vicinity of the tool, for monitoring different aspects of the drill string's rotation, and especially the drill string's rotational speed.

For any number of reasons, certain tools on the drill string may not have locally sensed or otherwise detected rotational information or data about the drill string, even though such information is either required by, or beneficial to operation of the particular tool. In some instances, sensors provided at the tool can malfunction or fail and cease to provide accurate rotational information. Still further, some materials from which tools are constructed can negatively affect sensors' abilities to function; for instance, sensors will often not work across certain metals. If these metals are used in a tool's construction, it may not be possible to include a sensor.

BRIEF DESCRIPTION OF THE DRAWINGS

Implementations of the present technology will now be described, by way of example only, with reference to the attached figures, wherein.

DETAILED DESCRIPTION

Figure 1:
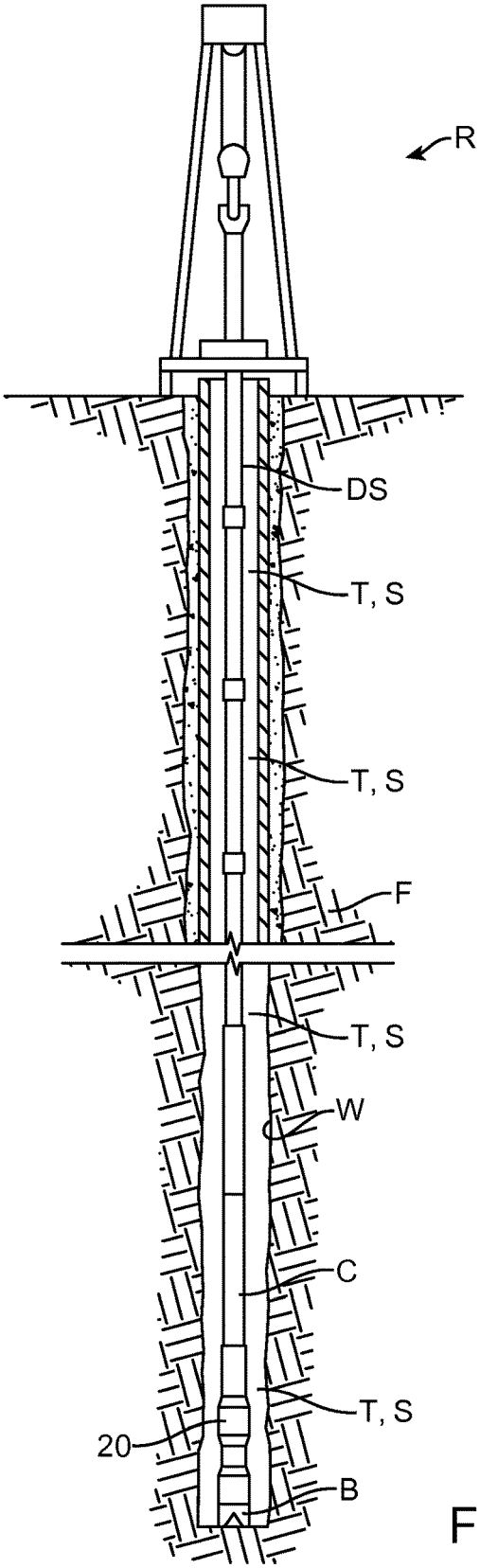
FIG. 1 is a diagram illustrating an embodiment of a drilling rig for drilling a wellbore with the drilling system in accordance with the principles of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, and the like orientations shall mean positions relative to the orientation of the wellbore or tool. Additionally, the illustrated embodiments are depicted so that the orientation is such that the right-hand side is downhole compared to the left-hand side.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other thing that "substantially" modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Drill String

FIG. 1 of the drawings illustrates a drill string, indicated generally by the reference letters DS, extending from a conventional rotary drilling rig R and in the process of drilling a wellbore W into an earth formation F. The lower end portion of the drill string DS includes a drill collar C, and a drill tool or bit B at the end of the string DS, and a rotary steerable drilling device (20) discussed further below. The drill bit B may be in the form of a roller cone bit or fixed cutter bit or any other type of bit known in the art. In certain configurations, the wellbore W is drilled by rotating the drill string DS, and therefore the drill bit B, from the rig R in a conventional manner. These components are recited as illustrative for contextual purposes and are not intended to limit the disclosure provided herein.

Also shown in FIG. 1 is an embodiment of a rotary steerable drilling device (20). As shown therein, the rotary steerable drilling device (20) is positioned on the drill string DS, before the drill bit B. However, the positioning of the rotary steerable drilling device (20) on the drill string DS and relative to other components on the drill string DS may be modified while remaining within the scope of the present disclosure.

During operation of a rotary steerable drilling device (20), frequent rotational measurements (such as revolutions per minute (RPM), measurements) of the drill string and/or drill shaft are important for optimal steering and control. Generally, rotational measurements are primarily made by sensors included within the rotary steerable drilling device in order to provide the necessary rotational information for control purposes. However, additional tools in the drill string DS can have rotational data sensors that can alternatively supply the necessary rotational information.

Drill string DS can have a number of rotation sensor containing tools T or rotation sensors S along the length of the drill string DS. "Tools" refer to various components, machines, or mechanical or electrical mechanisms which serve a particular purpose or carry out a function or action on the drill string DS. These can include, for example, fixed-cutter bits, rolling cone bits, impregnated bits, core bits, eccentric bits, bicenter bits, hybrid bits, reamers, mills, pressure housings, centralizers, stabilizers, open hole and cased hole logging tools, wireline tools, and other tools for use in wellbores as known in the art. Rotary steerable drilling device (20) can be considered a tool, and itself further contains tools, as well as a number of sensors that measure rotational data.

These tools along the drill string, together with the rotary steerable drilling device, can provide rotational data regarding the drill shaft and drill string. Additionally, or alternatively, rotational measurements may be made by sensors at several locations along the drill string, even in the absence of a tool. Rotational data can include or represent any rotational characteristic of the drill string, including for example, rotational or revolution speed, such as revolutions per minute (RPM), acceleration, velocity, positional data, changes in revolution speed, or other rotational data. Sensors within a tool or elsewhere which make rotational measurements include for example, RPM sensors, hall effect sensors, magnet containing sensors, or other sensors capable of measuring revolution speed or changes in revolution speed.

Rotary Steerable Drilling Device

Figure 2A:
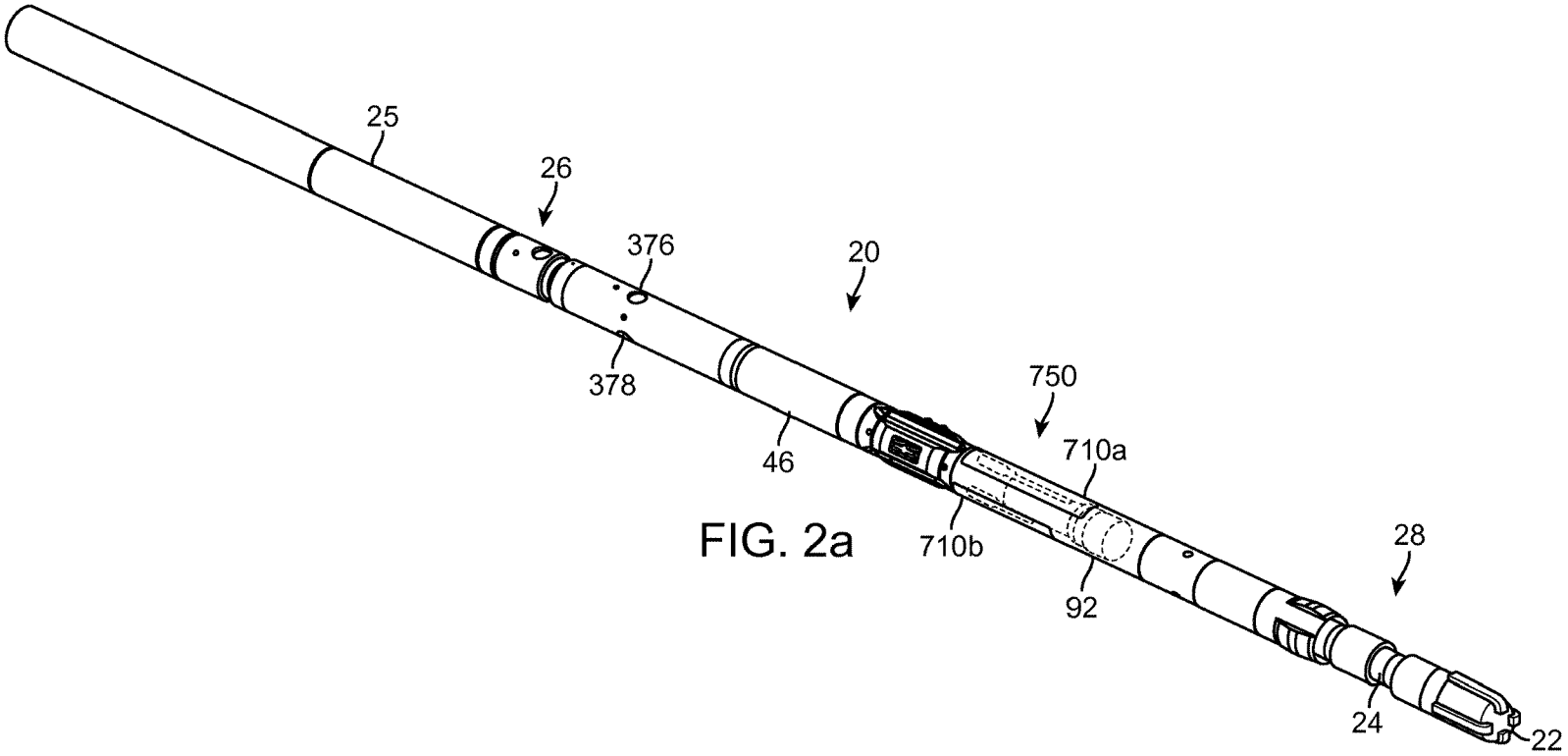
FIG. 2*a* is a diagram illustrating one embodiment of a rotary steerable drilling device in accordance with aspects of the present disclosure.
Figure 2B:
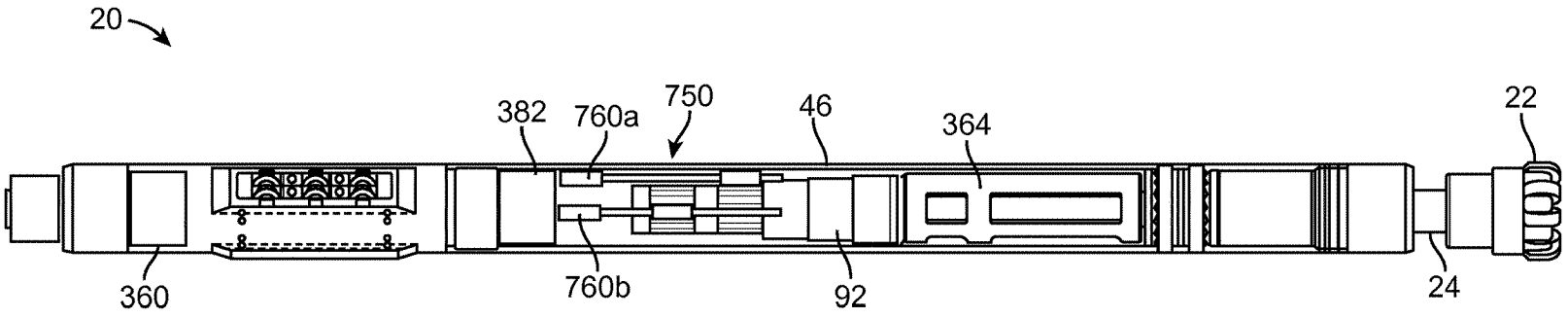
FIG. 2*b* is a diagram illustrating an embodiment of a rotary steerable drilling device.

An exemplary rotary steerable drilling device (20) is illustrated for example in FIGS. 2*a* and 2*b*. The drilling direction of the rotary steerable drilling device (20) is comprised of a rotatable drilling shaft (24) that is connectable or attachable to a rotary drilling bit (22) and to a rotary drill string (25) during drilling operations. More particularly, the drilling shaft (24) has a proximal end (26) closest to the earth's surface and a distal end (28) deepest in the well, furthest from the earth's surface. The proximal end (26) is drivingly connectable or attachable with the rotary drill string (25) such that rotation of the drill string (25) from the surface results in a corresponding rotation of the drilling shaft (24). The distal end (28) of the drilling shaft (24) is drivingly connectable or attachable with the rotary drilling bit (22) such that rotation of the drilling shaft (24) by the drill string (25) results in a corresponding rotation of the drilling bit (22). The distal end (28) of the drilling shaft (24) may be permanently or removably attached, connected or otherwise affixed with the drilling bit (22) in any manner and by any structure, mechanism, device or method permitting the rotation of the drilling bit (22) upon the rotation of the drilling shaft (24). In the exemplary embodiment, a threaded connection is utilized.

The rotary steerable drilling device (20) is comprised of a housing (46) for rotatably supporting a length of the drilling shaft (24) for rotation therein upon rotation of the attached drill string (25). The housing (46) may support, and extend along any length of the drilling shaft (24). However, in the illustrated example, the housing (46) supports substantially the entire length of the drilling shaft (24) and extends substantially between the proximal and distal ends (26, 28) of the drilling shaft (24).

The deflection assembly (92) within the rotary steerable drilling device (20) provides for the controlled deflection of the drilling shaft (24) resulting in a bend or curvature of the drilling shaft (24), as described further below, in order to provide the desired deflection of the attached drilling bit (22). The orientation of the deflection of the drilling shaft (24) may be altered in order to change the orientation of the drilling bit (22) or toolface, while the magnitude of the deflection of the drilling shaft (24) may also be altered to vary the magnitude of the deflection of the drilling bit (22) or the bit tilt relative to the housing (46).

The rotary steerable drilling device (20) optionally has a housing orientation sensor apparatus (364) for sensing the orientation of the housing (46) within the wellbore. The housing orientation sensor apparatus (364) can contain an At-Bit-Inclination (ABI) insert associated with the housing (46). Additionally, the rotary steerable drilling device (20) can have a drill string orientation sensor apparatus (376). Sensors which can be employed to determine orientation include for example magnetometers and accelerometers. The rotary steerable drilling device (20) also optionally has a releasable drilling-shaft-to-housing locking assembly (382) which can be used to selectively lock the drilling shaft (24) and deflection housing (46) together. In some situations downhole, it is desired that the shaft (24) not be able rotate relative to the housing (46). One such instance can be if the drilling device (20) gets stuck downhole; in that case it may be desirable to attempt to rotate the housing (46) with the drill string to dislodge the drilling device (2) from the wellbore. In order to do that, the locking assembly (382) is engaged (locked) which prevents the drilling shaft (24) from rotating in the housing (46), and turning the drill string turns the housing (46).

Further, in order that information or data may be communicated along the drill string (25) from or to downhole locations, the rotary steerable drilling device (20) can include a drill string communication system (378). Communications can include wired or wireless, as well as "mud pulse" or any other known or conventional drill string communication device. The drill string communication system (378) may be comprised of any system able to communicate or transmit data or information from or to downhole locations. The drill string communication system (378) can include an MWD or Measurement-While-Drilling system or device.

Deflection Mechanism

There are a number of methods for deflecting and bending the drilling shaft (24) in order to orient or direct the drilling bit (22). The rotary steerable drilling device (20) comprises a drilling shaft deflection assembly (92) contained within the housing (46) for bending the drilling shaft (24) therein.

Figure 3:
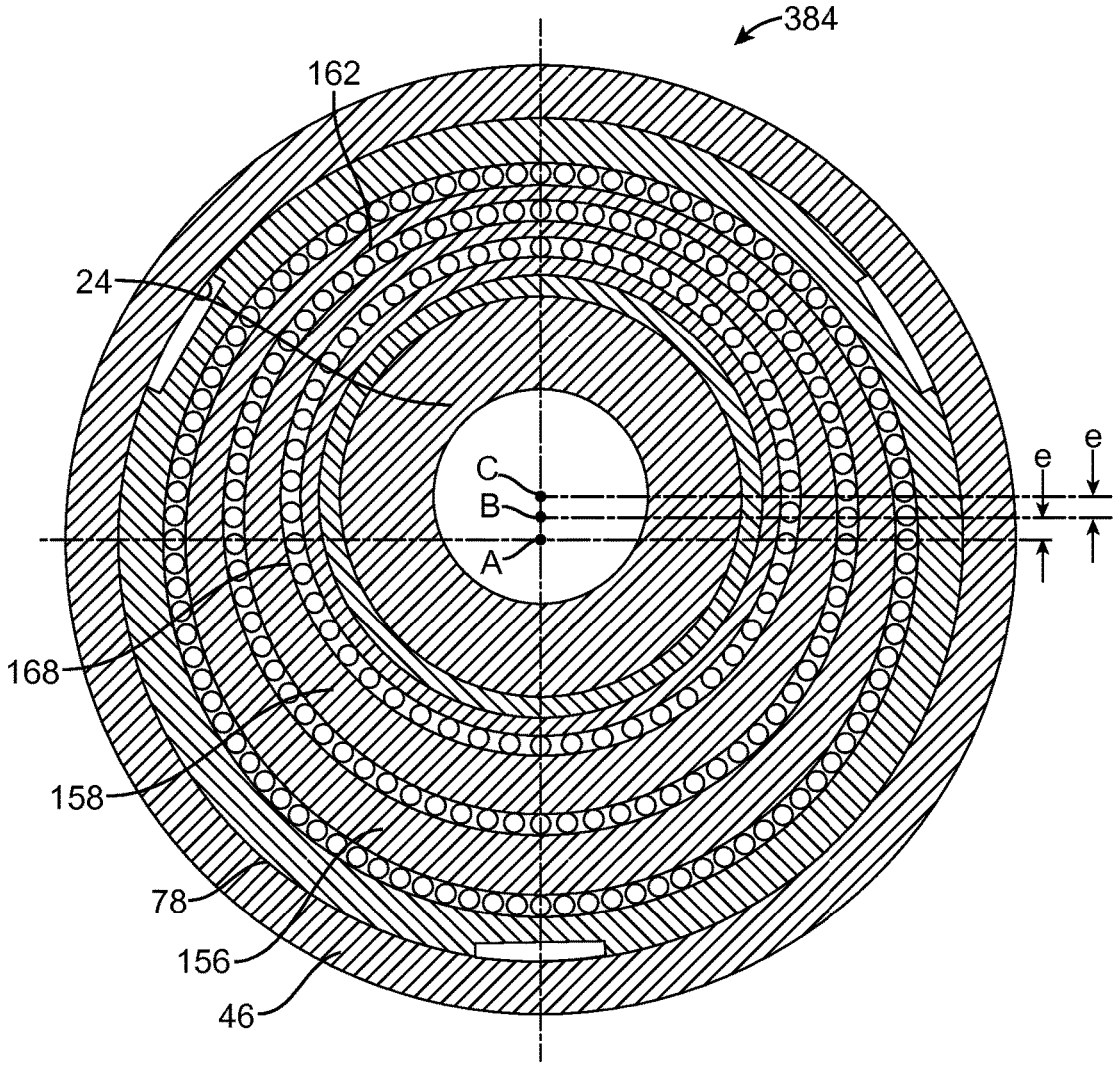
FIG. 3 is a diagram illustrating a drilling shaft deflection assembly, including a rotatable outer eccentric ring and a rotatable inner eccentric ring.

The deflection assembly (92) includes a mechanism for imparting lateral movement to the drilling shaft (24). As shown in the exemplary embodiment illustrated in FIG. 3, the deflection mechanism (384) is comprised of a double ring eccentric mechanism. The eccentric rings may be located at a spaced apart distance from one another along the length of the drilling shaft (24). However, in the illustrated example, the deflection mechanism (384) is comprised of an eccentric outer ring (156) and an eccentric inner ring (158), provided one within the other at the same axial location or position along the drilling shaft (24), within the housing (46). Rotation of one or both of the two eccentric rings (156, 158) imparts a controlled deflection of the drilling shaft (24) at the location of the deflection mechanism (384).

The circular inner peripheral surface (78) of the housing (46) is centered on the center of the drilling shaft (24), or the rotational axis "A" of the drilling shaft (24), when the drilling shaft (24) is in an undeflected condition or the deflection assembly (92) is inoperative. The circular inner peripheral surface (162) of the outer ring (156) is centered on point "B" which is offset from the centerlines of the drilling shaft (24) and housing (46) by a distance "e."

The circular inner peripheral surface (168) of the inner ring (158) is centered on point "C", which is deviated from the center "B" of the circular inner peripheral surface (162) of the outer ring (156) by the same distance "e". As described, preferably, the degree of deviation of the circular inner peripheral surface (162) of the outer ring (156) from the housing (46), defined by distance "e", is substantially equal to the degree of deviation of the circular inner peripheral surface (168) of the inner ring (158) from the circular inner peripheral surface (162) of the outer ring (156), also defined by distance "e".

Upon the rotation of the inner and outer rings (158, 156), either independently or together, the center of the drilling shaft (24) may be moved with the center of the circular inner peripheral surface (168) of the inner ring (158) and positioned at any point within a circle having a radius equal to the sum of the amounts of deviation of the circular inner peripheral surface (168) of the inner ring (158) and the circular inner peripheral surface (162) of the outer ring (156).

In other words, by rotating the inner and outer rings (158, 156) relative to each other, the center of the circular inner peripheral surface (168) of the inner ring (158) can be moved to any position within a circle having the predetermined or predefined radius as described above. Thus, the portion or section of the drilling shaft (24) extending through and supported by the circular inner peripheral surface (168) of the inner ring (158) can be deflected by an amount in any direction perpendicular to the rotational axis of the drilling shaft (24).

Powering the Deflection Assembly

Figure 4:
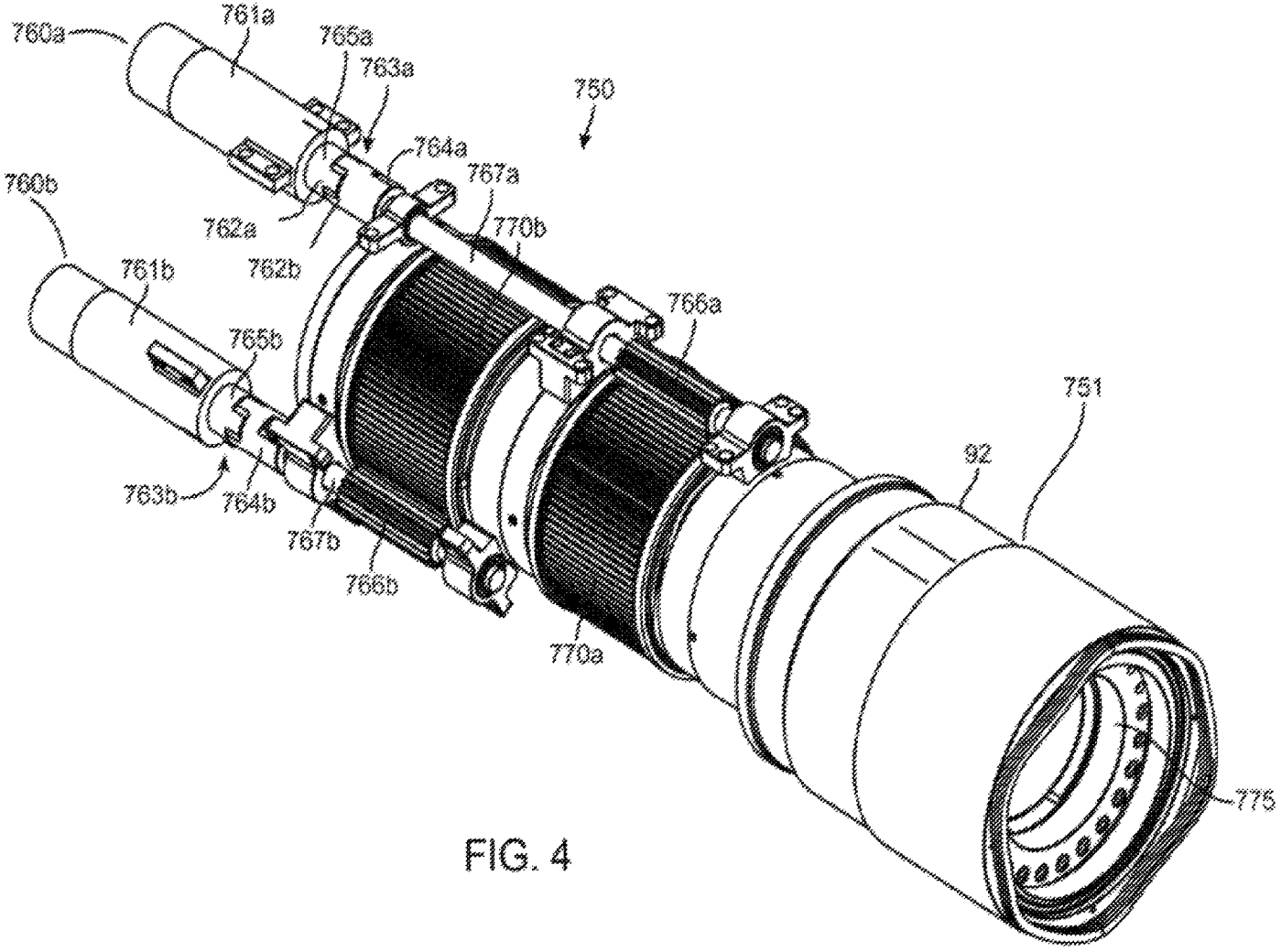
FIG. 4 is a diagram illustrating a drive motor assembly for the drilling shaft deflection assembly.

A mechanical actuator is disclosed that employs at least one motor for rotating the eccentric rings of the drilling shaft deflection assembly (92). Referring to FIG. 4, a drilling shaft deflection device (750) is shown with the housing removed, exposing the internal portion of the deflection device (750).

Two brushless DC (BLDC) drive motors are provided; an outer eccentric ring drive motor (760*a*) and an inner eccentric ring drive motor (760*b*). Any type of motor may be used capable of providing rotational bias or power to the eccentric rings, including but not limited to hydraulic motors and electric motors. Suitable electric motors include AC motors, brushed DC motors, piezo-electric motors, and electronically commutated motors (ECM). The term ECM can include all variants of the general class of electronically commutated motors, which may be described using various terminology such as a BLDC motor, a permanent magnet synchronous motor (PMSM), an electrically commutated motor (ECM/EC), an interior permanent magnet (IPM) motor, a stepper motor, an AC induction motor, and other similar electric motors which are powered by the application of a varying power signal, including motors controlled by a motor controller that induces movement between the rotor and the stator of the motor.

In some examples the ECM can have built-in features which are inherent or included in the device. For example, the ECM can optionally have a braking mechanism, such as a detent brake, to prevent movement of the output shaft of the motor when the ECM is not being purposefully rotated. An additional built-in feature can include a feedback mechanism such as an included resolver or associated Hall effect sensors that track the position of the rotor relative to the stator in order to facilitate operation of the ECM by the motor controller.

Referring again to FIG. 4, the eccentric ring drive motors (760*a*, 760*b*) can be substantially cylindrical and small relative the size and diameter of the housing (46). The eccentric ring drive motors (760*a*, 760*b*) can be housed in a motor housing which provides a surface which substantially contains the contents of the drive motor components. The drive motor housings (761*a*, 761*b*), are radially offset, aside the longitudinal centerline of the housing (46). Further, the motor housings (761*a*, 761*b*) of drive motors (760*a*, 760*b*) can be anchored to the housing (46) located proximate thereto. The motor housings (761*a*, 761*b*) of the drive motors (760*a*, 760*b*) can be circumferentially spaced apart one from another about the housing (46). In such case, the motor housings (761*a*, 761*b*) of the drive motors (760*a*, 760*b*) can be circumferentially spaced apart, one from another, by any degree, including about 45 degrees, or about 60 degrees, or about 70 degrees, or about 90 degrees, or about 120 degrees, or about 180 degrees, and in some examples less than about 90 degrees, or less than about 180 degrees around the housing (46).

The drive motors (760*a*, 760*b*) are each coupled to a pinion (766*a*, 766*b*) via upper spider coupling (763*a*) and lower spider coupling (763*b*). The spider couplings (763*a*, 763*b*) are each comprised of opposing interlocking teeth (762*a*, 762*b*) which communicate rotation from the drive motors (760*a*, 760*b*) to a set of pinions (766*a*, 766*b*). The upper coupling portion (765*a*, 765*b*) of each spider coupling (763*a*, 763*b*) includes a series of teeth and channels that engage a similar (mirror image) series of teeth and channels on the lower coupling portion (764*a*, 764*b*) of each spider coupling (763*a*, 763*b*). There can be drive shafts (767*a*, 767*b*) which extend from the lower coupling portion (764*a*, 764*b*) to an outer eccentric ring pinion (766*a*) and inner eccentric ring pinion (766*b*). The respective pinions (766*a*, 766*b*) are each splined, having gear teeth that engage with an outer eccentric ring spur gear (770*a*) and inner eccentric ring spur gear (770*b*). The spur gears (770*a*, 770*b*) are each splined, having gear teeth that surround the entire peripheral edge of the respective gear and receive the teeth from pinions (766*a*, 766*b*). The spur gears (770*a*, 770*b*) can have substantially the same diameter, with a circumference less than that of the housing (46), and in some examples may be the same or greater than the outer eccentric ring (156).

The pinions (766*a*, 766*b*) are positioned adjacent the spur gears (770*a*, 770*b*), at their periphery, so that pinion teeth intermesh with spur gear teeth as shown in FIG. 4. The motors (760*a*, 760*b*) provide rotational driving force that is communicated through the spider coupling (763*a*, 763*b*) and drive shafts (767*a*, 767*b*) causing rotation of the pinions (766*a*, 766*b*). The rotating pinions (766*a*, 766*b*) engage and rotate the spur gears (770*a*, 770*b*). The spur gears (770*a*, 770*b*) can be connected directly or indirectly to the outer and inner eccentric rings (156, 158) contained within the body of the deflection device (750). For example, spur gears (770*a*, 770*b*) can be bolted to inner and outer eccentric rings (156, 158). In the illustrated example, the outer eccentric ring spur gear (770*a*) is coupled to the outer eccentric ring (156) via a linkage, which may take the form or an interconnected cylindrical sleeve. The inner eccentric spur gear (770*b*), however, is coupled to the inner eccentric ring (158) via an Oldham coupling. The Oldham coupling permits off-center rotation and the necessary orbital motion of the inner eccentric ring (158) relative the housing (46).

The inner eccentric ring spur gear (770*b*) permits deflection or floating of the drilling shaft (24) held in the interior aperture of the inner eccentric ring (156). As the drilling shaft (24) orbits about within the housing (46) as the orientations of the eccentric rings change, the powering transmission, at least to the inner eccentric ring (156), must shift in order to maintain connection to the ring (156), and this is accomplished by use of the Oldham coupling.

In the illustrated embodiment of FIG. 4, the drive motors (760*a*, 760*b*) are positioned at the top or proximal end (left side of the FIG. 4) of the drilling shaft deflection device (750). As shown, the outer eccentric ring pinion (766*a*) is positioned further down, toward the distal end of the drilling shaft deflection device (750). The drive motors (760*a*, 760*b*) may be lengthwise offset, one from the other, relative the housing (46).

The outer eccentric ring spur gear (770*a*) and inner eccentric ring spur gear (770*b*) are positioned adjacent one another, but with the outer eccentric ring spur gear (770*a*) positioned further along the body in the distal direction.

With respect to deflection, the motors can rotate the eccentric rings to bend the drilling shaft (24) to any desired deflection ranging from no deflection up to the maximum amount mechanically permitted.

In order to deflect drilling shaft (24), outer eccentric ring drive motor (760*a*) can hold outer eccentric ring (156) from rotating while at the same time inner eccentric ring drive motor (760*b*) can apply rotating force to rotate inner eccentric ring (158) in either direction (clockwise or counterclockwise; i.e., bi-directional). Alternatively, inner eccentric ring drive motor (760*b*) can hold inner eccentric ring (158) from rotating while at the same time outer eccentric ring drive motor (760*a*) can apply rotating force to rotate outer eccentric ring (156) in either direction. Additionally, both motors (760*a*, 760*b*) can be simultaneously operated which correspondingly rotates eccentric rings (156, 158) to achieve a desired deflection.

In practice, a control signal is sent to one or both motors (760*a*, 760*b*) which then actuates and applies a rotating force through one or both spider couplings (763*a*, 763*b*) to drive the shafts (765*a*, 765*b*) that rotate their respective pinions (766*a*, 766*b*). The pinions (766*a*, 766*b*) engage and rotate their respective spur gears (770*a*, 770*b*), which communicate rotation to the respective eccentric rings (156, 158). In this way, the eccentric rings can be singly, or simultaneously rotated from a position in which the axial centers are aligned (i.e., "e" minus "e" equals zero) to any other desired position within a circle having a radius of "2e" around the centerline A of the housing (46). In this way the drilling shaft (24) is deflected at a desired angle. That is, the amount of deflection is affected based on how far the drilling shaft (24) is radially displaced (pulled) away from the centerline of the housing (46). The degree of radial displacement can be affected by rotation of one or both of the eccentric rings (156, 158), in either direction.

Managing Rotational Data

As mentioned before, rotational characteristics of a drill string and an associated drill shaft affect many aspects of a rotary steerable drilling operation including the steering function. Rotation rate can vary along the length of the drill string and shaft due to, among other things, the natural flex of their materials of construction, drag caused by contact with sides of the wellbore, extreme downhole conditions and resistance to rotation experienced at the drill bit. For purposes of this discussion, the drill string is considered to include the drill shaft (24) of the rotary steerable drilling device (20). For optimal drilling operations, it is advantageous to have rotational information about the drill string, such as prevailing rotations-per-minute (RPM), available at the rotary steerable drilling device (20). Similarly, such rotational information can also be used by other tools throughout the drill string in order to carry out their respective functionalities. In fact, many tools along the drill string require rotational information in order to carry out their particular purposes. Accordingly, sensors are often provided locally, within a tool, or within the immediate vicinity of the tool, for monitoring different aspects of the drill string's rotation, and especially the drill string's rotational speed. In the absence of sensor-including-tools, stand-alone sensors can be placed at intervals along the length of the drill string to provide relevant rotational information.

For any number of reasons, certain tools on the drill string may not have locally sensed or otherwise detected rotational information or data about the drill string, even though such information is either required by, or beneficial to operation of the particular tool. Further, in some instances, sensors provided at the tool, such as in a rotary steerable drilling device (20), can malfunction or fail and cease to provide accurate rotational information. For example, extreme environmental conditions within the wellbore can interfere with measurements being made by the rotation sensor or cause its malfunction. In addition, there may be design constraints imposed by the tool's package, such as too little space to accommodate a needed rotation sensor. Alternatively, the nature of the tool or its location on the drill string may prevent the sensor's placement relative the drill string to properly observe the string's rotation.

In another aspect, the materials from which the tool is constructed can negatively affect a sensor's ability to function; for instance, sensors will often not work across certain metals. If these metals are used in the tool's construction, it may not be possible to include a sensor. Therefore, in some examples disclosed herein, tools that require drill string rotational information for their operation have the capability to obtain the information from other sensor-including-tools in the drill string or from stand-alone sensors along the drill string. The rotational information from other tools or sensors can be obtained and transmitted manually or automatically. Moreover, rotational information (data) about the drill string that is obtained from multiple sources can be managed in the aggregate, including collecting, processing and disseminating the information or information derived therefrom.

In these regards, a controller can be employed to manage data, carry out calculations, make determinations (which can include calculations and other manipulations of data), receive and output rotation data, control communications, and conduct other functions or processes according to this disclosure. The controller or controllers implementing the processes according to the present disclosure can comprise hardware, firmware and/or software, and can take any of a variety of form factors. In particular, the controllers described herein can include at least one processor optionally communicatively coupled directly or indirectly to memory elements through a system bus, as well as program code for executing and carrying out the processes described.

"Processor" as used herein is an electronic circuit that can make determinations based upon inputs and is interchangeable with the term "controller". A processor can include a microprocessor, a microcontroller, and a central processing unit, among others. While a single processor can be used, the present disclosure can be implemented over a plurality of processors, including local controllers in the tool (rotary steerable drilling device), or at other tools or sensors along the drill string. The controller(s) may take the form of a global controller which controls many aspects of the drill string, and the rig in general, and they can be located anywhere on the rig, including downhole. Advantageously, at least part of the controller can be located above ground and include a user interface that permits operator input and remote access from distant locations by either other users or controllers.

The memory elements can be a computer-usable or computer-readable medium for storing program code for use by or in connection with one or more computers or processors. The medium can be an electronic, magnetic, optical, electromagnetic, infrared, or semiconductor system (or apparatus or device) or a propagation medium (though propagation mediums in and of themselves as signal carriers are not included in the definition of physical computer-readable medium). Examples of a physical computer-readable medium include a semiconductor or solid state memory, magnetic tape, a removable computer diskette, a random access memory (RAM), a read-only memory (ROM), a rigid magnetic disk and an optical disk. The program code can be software, which includes but is not limited to firmware, resident software, microcode, a Field Programmable Gate Array (FPGA) or Application-Specific Integrated Circuit (ASIC) and the like. Implementation can take the forms of hardware, software or both hardware and software elements.

Moreover, the controllers can be referred to as being "communicatively coupled" among themselves and to other things. This terminology means the devices are connected, either directly or indirectly through intervening components, and the connections are not necessarily limited to physical connections, but are connections that accommodate the transfer of data between the so-described components. Communicatively coupled devices can include for example input and output devices coupled either directly or through intervening I/O controllers. In the present disclosure, the communication couplings are often between the controllers and sensors that provide information or data, and tools that utilize or consume information or data. Regarding a rotary steerable drill (20), communication couplings can be to sensors of various types, including rotation sensors that detect a rotational characteristic such as rotational speed. The sensors can also include toolface direction sensors, orientation sensors and sensors in the housing orientation apparatus.

In order to communicate between sensors, controllers and various tools along the drill string, including rotary steerable devices and/or surface controller(s), a drill string communication system (378) can be used. The drill string communication system (378) can include a communication channel extending the entire distance of the drill string from the surface to the drill bit (22), and communicatively link all, some, or a plurality of rotation sensors, tools, controllers and the like. In some examples, the communication channel is a communication bus extending along a length of the drill string and communicatively interconnecting a plurality of constituent sensors, tools, and controllers of the drill string. The communication channel can be wired, wireless, or include mud pulse, or any other form of communication along a drill string, and various combinations thereof.

Figure 5:
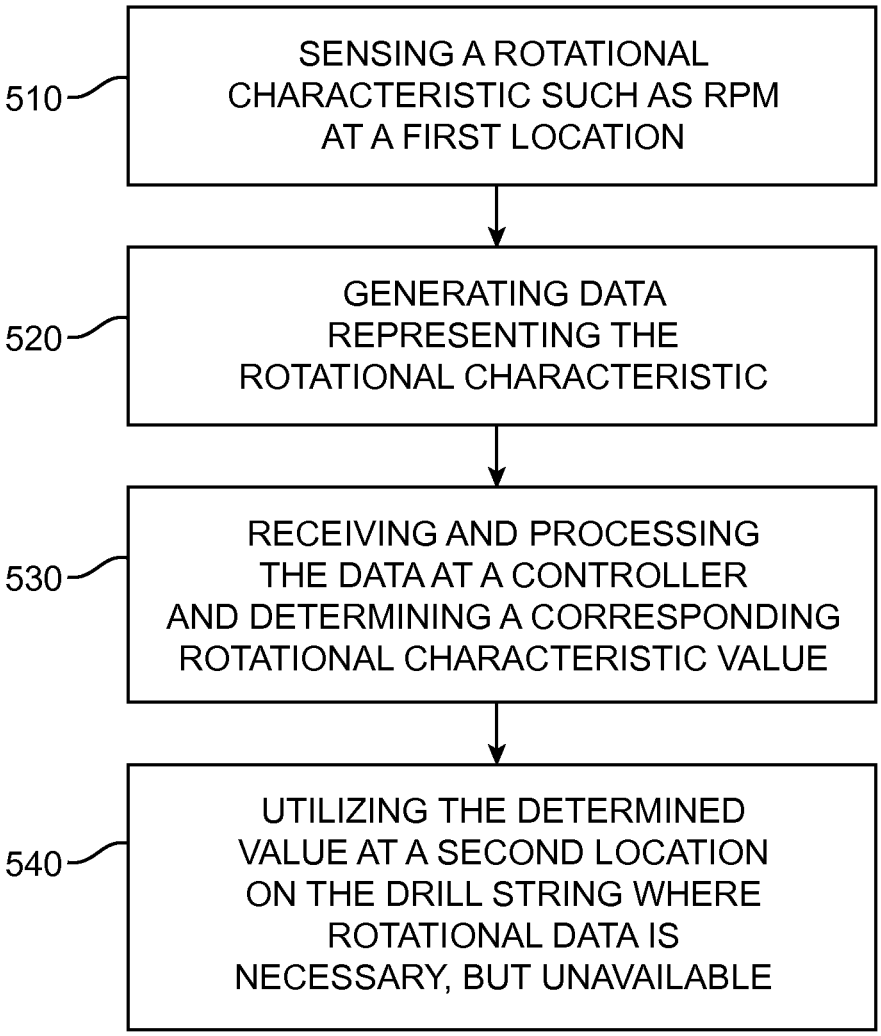
FIG. 5 is a flow diagram illustrating a method conducted according to the present disclosure.

In the embodiment of FIG. 5, a method for sharing rotational information between components of a subterranean drill string is illustrated. Initially, a rotational characteristic of the drill string is sensed (510) at a first location on the drill string, and at a controller (361) (shown in FIG. 8), data representative of the detected characteristic is generated (520) is received. Using the controller (361), a corresponding rotational characteristic value is determined (530) in dependence upon the received data that is representative of the detected rotational characteristic of the drill string sensed at the first location on the drill string for utilization at another location than the first location on the drill string (540). In this illustration, the sensed rotational characteristic can be a RPM measurement, and the determined corresponding value can be either the same RPM value, or a value resulting from processing the data that has been generated, and which is representative of the RPM rotational characteristic.

The determined rotational characteristic value can be associated with either a portion of, or the entirety of the drill string for utilization at other locations than the first location on the drill string. In this regard, the controller (361) outputs data representative of the corresponding rotational characteristic value for utilization at a second location on the drill string.

Instead of a single detection, multiple detections of the rotational characteristic can be made from different locations on the drill string, including the first location, and corresponding data sent to the controller (361). This data can then be analyzed by the controller (361) and a corresponding rotational characteristic value determined in dependence thereupon.

To facilitate distribution of the information, the rotational characteristic value can be output to a communication channel and broadcast along the drill string for utilization at a plurality of locations on the drill string, including the second location. As an example, the communication channel can be a communication bus extending along a length of the drill string and that communicatively interconnects a plurality of constituent tools of the drill string.

Advantageously, the detected rotational characteristic of the drill string sensed at the first location on the drill string is revolution speed and the corresponding rotational characteristic value for utilization at the second location on the drill string is a revolution speed value determined from the detected revolution speed at the first location. However, the instance of multiple RPM measurements, the determination of the revolution speed value can take the form of averaging the detected revolution speeds sensed at the plurality of locations, with the result being the determined revolution speed value. Still further, the determined corresponding rotational characteristic value can be an acceleration value determined from a detected change in revolution speed.

Figure 6:
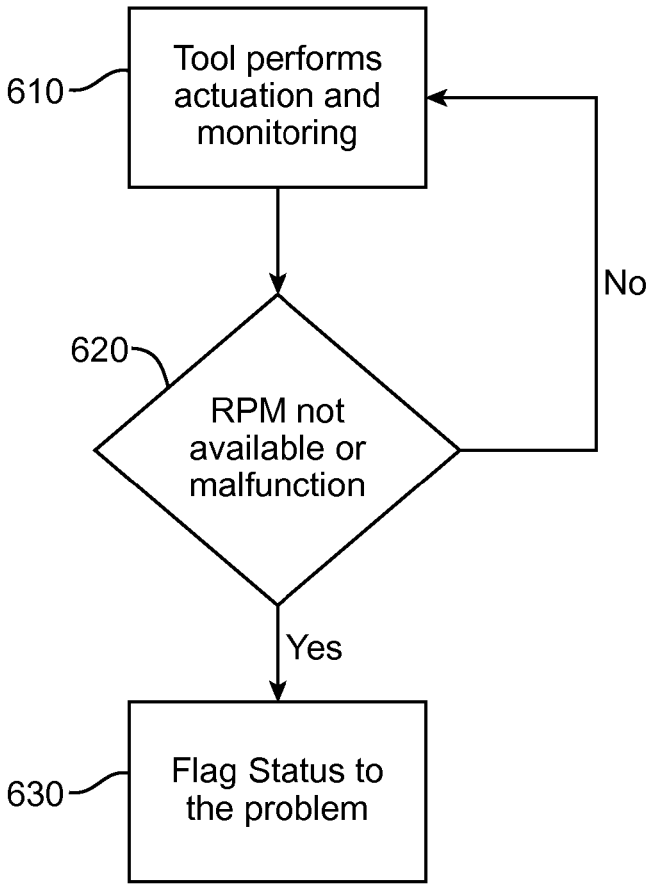
FIG. 6 is a flow diagram of a local tool function determining rotational information availability.

The exemplary flow diagram depicted in FIG. 6 illustrates the instance in which rotational information, such as RPM data, is relayed to a local tool requiring the rotational information, unless the information is unavailable, perhaps because of a sensor malfunction. If a malfunction is detected, than a status flag issues alerting about the problem.

Illustratively, the local tool can be a rotary steerable drilling device (20) having a rotary device controller (360) (shown in FIG. 2*b*). In the case of FIG. 6, the rotary steerable drilling device (20) requires rotational information for operation, but the information is locally unavailable. In response to detecting the lack of information, access can be provided to rotational data generated remotely on the drill string. In other embodiments, the method of FIG. 6 can be applied to other controllers and tools in the drill string. In such cases, the tool requiring information can receive rotational information from other tools that are remotely located, including, potentially from a rotary steerable drive system on the drill string.

When referring to a local controller, such as a rotary device controller (360), described processing is not limited to a particular controller. Moreover, when referring to a tool carrying out a controller process, it should be understood that a controller within the tool, or communicatively coupled to the tool, actually carries out the processing function.

As shown in FIG. 6, for a local tool that requires rotational information, the first step 610, includes "Tool performs actuation and monitoring." In this step the tool is attempting to conduct a particular function, namely actuation of a function or action. Where the tool is a rotary steerable drilling device (20), actuation can involve the rotation of one or both eccentric rings (156, 158) in order to deflect or rotate the drill shaft (24) within the system. The step includes "monitoring" which involves an attempt by a controller to obtain rotational data regarding the drill shaft. Rotational information can include quantification (measurement) of any rotational characteristic of the drill string; for example, revolution speed such as RPM, revolution acceleration and any other rotational aspect of the drill string. Successful retrieval of rotational information can be used for carrying out the intended actuation and/or other tool function.

The second step 620 of FIG. 6 includes "RPM not available or malfunction." This step involves checking whether rotational information is available. If rotational information is obtained, processing returns to 610 and the activity that is dependent on rotational information is performed. However, if rotational data is not retrieved, the process proceeds to step 630. This step can be carried out by a controller local to the tool. In the case of a rotary steerable drilling device (20), it can include for example rotary device controller (360). The rotary device controller (360) can check whether rotational data is available by determining whether a rotation sensor is providing data representative of a rotational characteristic. In the instance of other tools along the drill string, if the tool does not contain sensors, a controller can also determine that no data is available in this situation. The occurrence of this step signifies the unavailability of sensor information for any number of reasons, including failure, or malfunction in a rotational characteristic sensor at the local tool, or the absence of a sensor.

The third step 630 in FIG. 6 includes "Flag status to the problem." After rotational data is determined unavailable, this step involves the local tool logging, flagging, or creating a status noting that rotational data is unavailable. While this step can apply to any local tool along the drill string, if it's a rotary steerable drilling device (20), the rotary device controller (360) determines that no rotational data is being received, and therefore flags such a status. This status can be communicated to the operator of the drilling system. Alternatively, the problem status can be flagged or set by the operator after failing to receive rotational data from the local tool. The detection and flag set can also be automated at the rotary device controller (360).

Figure 7:
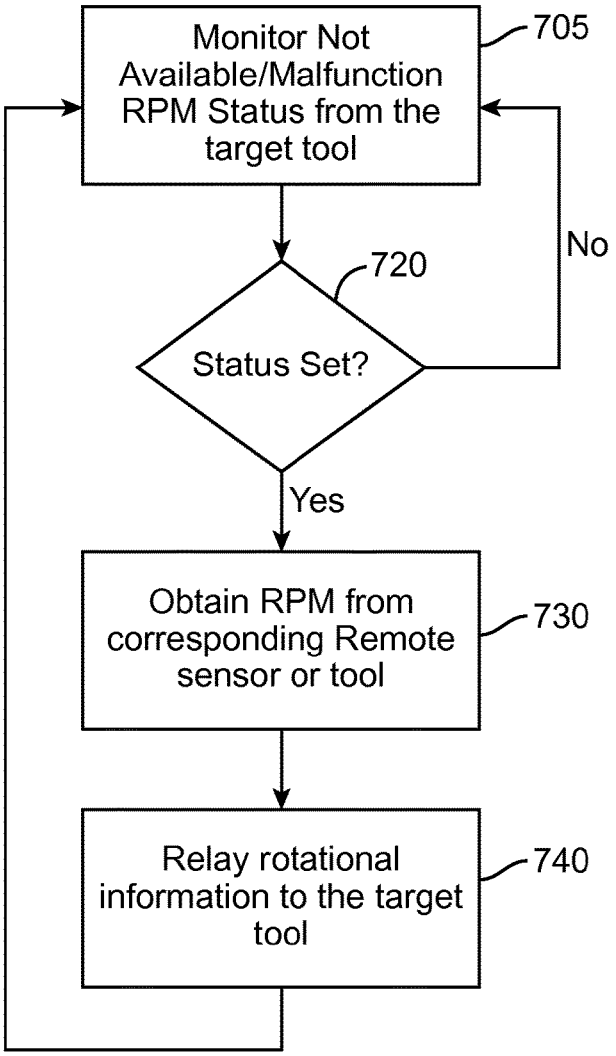
FIG. 7 is a flow diagram related to the sharing of rotational information.

While FIG. 6 indicates the specific steps carried out in the local tool, FIG. 7 illustrates the overall system function for providing remote rotational data to the local tool. Step 705 involves "Monitor not available/malfunction RPM status from the target tool." In step 705, a controller in the drill string monitors the status of the subject tool regarding the availability of rotational information. The controller can be any controller along the drill string or surface, including at the rotary device controller (360) or operator surface controller. Additionally, in the case where a local tool has no sensor or if there are other problems with the sensor and rotational information is needed, the status may also include an "update required" status regarding the subject local tool, where an update regarding the status is needed.

As noted in step 630 of FIG. 6, if the local tool fails to obtain rotational information, a status flag is indicated. Correspondingly, in step 720 there is indicated a "Status set?" question, wherein a determination is made by a controller based on the status indicated by the local tool according to step 630. If the status is not set, meaning that the local tool does not show a status flag, or lacks a notification indicating that rotation information is unavailable, the flow returns to step 705. However, if the local tool shows a status flag, indicating no available rotational data, the flow proceeds to step 730.

Step 730 involves the step "Obtain RPM from corresponding remote sensor or tool." Accordingly, in step 730, a controller determines the best available rotational data as measured in a remote tool or by a remote sensor elsewhere in the drill string other than the local tool. As described above, there is a plurality, e.g., number (n) of rotation sensor tools or rotation sensors on the drill string. These can be monitored, observed and accessed by the operator or controller in the drill string. Accordingly, sensors and tools can generate detected or sensed rotational characteristic data and transmit or output these to a controller. Therefore, received at a controller, is data representative of a detected rotational characteristic of the drill string which is associated with a particular portion or portions of the drill string.

By viewing the data from various sensors and tools, a controller is able to determine the best available rotational data. This determination can be made automatically or manually. A number of factors can be employed for determining the best rotational data. This can include the proximity of the remote sensor or tool to the local sensor, location of the measurement, the type of sensors making the measurement, as well as other considerations. For example, the controller may determine that a particular portion of the string at a first location has the best rotational data. The controller can then determine that such rotational data representative of a rotational characteristic is adequate for provision to a tool at a second location or other tools on the drill string. Further, the controller can use the RPM data at the first location as a basis to determine a corresponding rotational characteristic value, for example an average RPM of the drill string, or an estimated RPM at the second location, and transmit such determined value along the drill string to a tool at a second location or broadcast to tools at other locations along the drill string.

Once the rotational information is obtained from the remote sensor or the particular remote sensor having the desired information is chosen, and the rotational characteristic value determined by the controller, this rotational information is transmitted to the local tool requiring the information as noted in step 740. Step 740 involves "Relay rotational information to the target tool." Accordingly, the controller outputs data representative of the determined rotational information to the local tool in need of such information at a second location along the drill string. Therefore, the rotational data is retrieved from a remote sensor by a controller from a first location and then transmitted to the target tool where rotational information is needed at a second location. With this information, the target local tool can conduct operations such as rotary steerable actuation and/or other functions. In the particular illustrated example where the local tool is a rotary steerable drilling device (20), once the rotary device controller (360) receives the relayed rotational information from a remote tool or sensor, actuation involves rotating eccentric rings (156, 158) to deflect or rotate the shaft. Further, once step 740 is complete, the flow returns to the step 705 and can be repeated any number of times. Additionally, such rotational information can be used not only at a local tool, but can be broadcast along the drill string communication channel to a plurality of locations and tools on the drill string.

The steps depicted in FIGS. 6 and 7 can be conducted manually or automatically. An automated response can enable shorter intervals between updates, as well as more accurate and consistent results of the implemented method. As discussed above, the automatic implementation can employ the use of a controller comprising a bus master, and/or software control. The controller can include a computer, processor or other hardware for implementation. The controller can automatically monitor the status of the local tool, and upon notification of unavailable status can update the local tool with rotational data from other remote tools. Additionally, the controller can analyze the rotational data from the remote tools, choose the best data based on the criteria described above, and relay it to the local tool. Algorithms can be included in the controller to carry out the monitor, selection and relay processes.

Other examples can include monitoring one or more local tools; for example, the system can be used to "manage" rotational data generated throughout the drill string. The rotational data from each tool can be used in the aggregate to evaluate and monitor the operation and function of the tool.

As noted, the drill string can include a plurality of tools at a plurality of locations along the length of the drill string which are capable of obtaining rotational information at that location on the drill string. This is illustrated, for example, in FIG. 8 where a drill string is depicted as having "n" number of tools in the drill string, spaced along the string's length. The number "n" refers to the fact that any number of tools can be included along the drill string, for example from 2 to 200 tools. Moreover, a rotary steerable drilling device can itself include a number of sensors and tools along its length. Considering that the rotary steerable drilling device can extend in some cases from 50 to 400 feet in length, data regarding the rotation of the drill shaft within the tool can be helpful for optimized steering. Further, tools located immediately proximate the drill string may be helpful in providing rotational data regarding the operation of the drill, as can other tools or sensors along the entire length to the surface.

Figure 8:
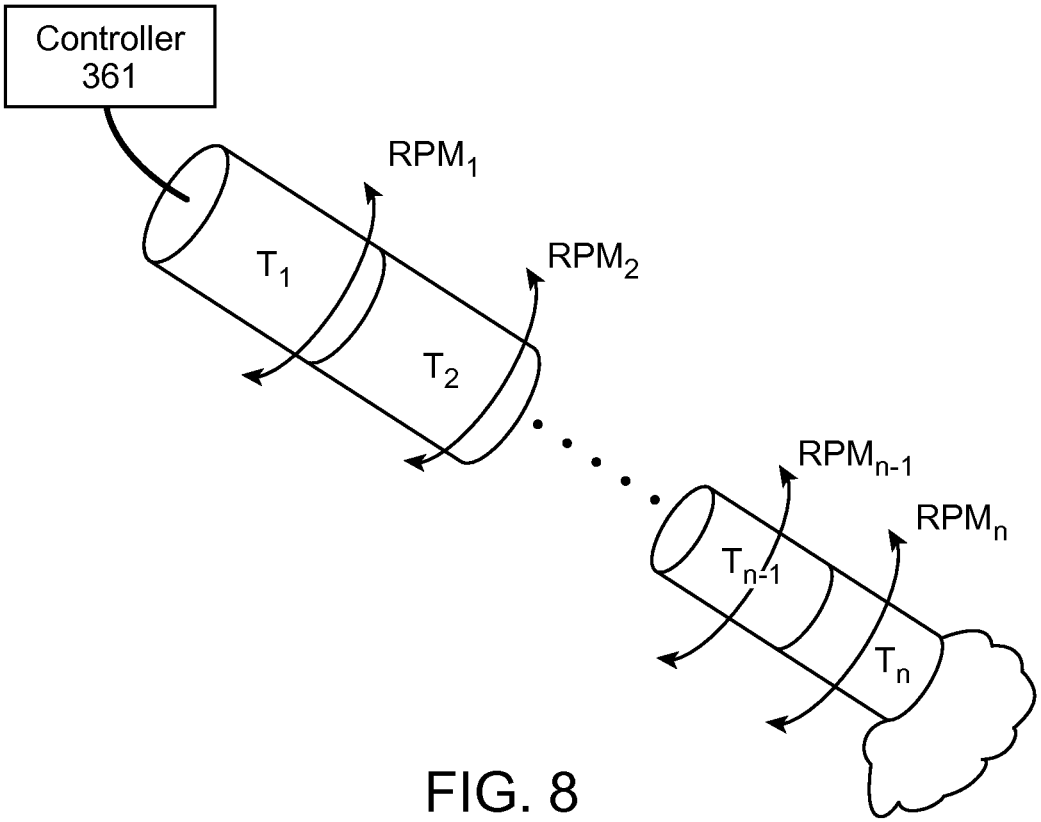
FIG. 8 illustrates one example showing a drill string having (n) number of tools and different detected rotation speeds.

Accordingly, referring to FIG. 8, tools "T" along the drill string can be consecutively numbered starting from the number "1" for the tool closest to the surface, to the nth tool closest to the distal end of the drill string. Tools labeled n−1 and n−2 refer to tools moving up the string away from the nth tool, the nth tool being the bottom-most, final tool at the distal end of the string. Alternatively, the tools in FIG. 8 may be stand-alone rotational information sensors, or a mixture of tools and stand-alone rotational information sensors.

Each tool "T" in FIG. 8 can have associated rotational information, such as RPM, which is also consecutively numbered according to the tool or location with which it is associated; RPM1, RPM2 . . . RPMn−1, RPMn−1, RPMn. The rotational information from each of the plurality of tools and/or sensors can be provided to a controller (361) (which can also encompass rotary device controller (360)). This information can be monitored and analyzed in the aggregate to serve operations, other tools, or functions related to the drilling process. Further, the information can detail what changes may be occurring along the length of the drill string, if any, and allow an operator to gauge the conditions along the drill string.

Figure 9:
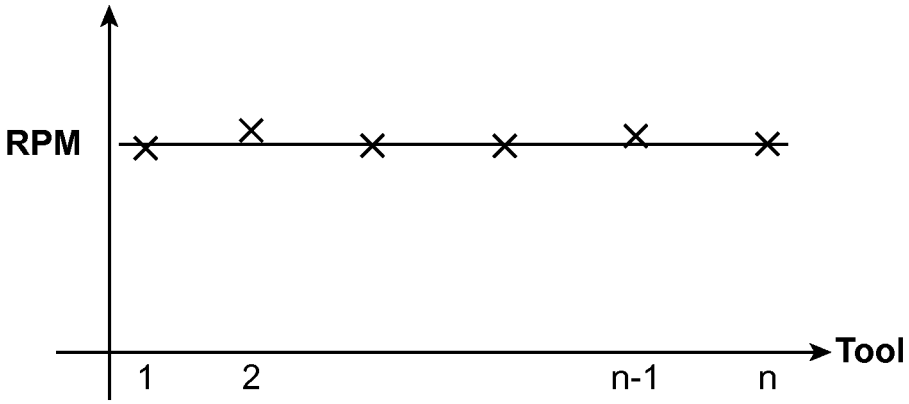
FIG. 9 is a graph illustrating RPM for (n) number of tools along the length of a drill string at one instant in time for approximating rotational information of the drill string.

As depicted in FIG. 9, the rotational information from the plurality of tools can be used by the controller to determine or infer corresponding rotational information along the length of the drill string. Illustrated in FIG. 9 is a graph showing the RPM as a function of the number of tools along the drill string. As shown, the tool number along the drill string referred to in FIG. 8 is depicted on the x-axis of FIG. 9 as 1, 2 . . . n−2, n 1, n. The rotational data, in this case RPM, is derived from each tool, and shown as "x." The graph of FIG. 9 shows the RPM for each tool at a particular instant in time, whether instantaneous, current, or past RPM.

By employing a linear approximation, corresponding RPM at various locations along the length of the drill string can be determined by inference or interpolation. For example, in FIG. 9, a line is drawn within the proximity of the marked "x" RPM's to obtain an approximated RPM of the string. The RPM can vary along the drill string's length as discussed above due to conditions in the wellbore, the path of the drill string in the wellbore, the natural flex of the shaft, as well as the sensitivity and accuracy of the sensors.

While linear approximation is used for best fit curve estimation in FIG. 9 based upon the presented RPM data pattern, it should also be appreciated that other curves may be appropriate depending upon the instant data pattern. For instance, a data pattern may be best fit using a sinusoidal curve. In that case, the fitted sinusoidal curve can be used for interpolation and extrapolation estimates inside and outside the data.

Further, the linear approximation shown in FIG. 9 can serve as a basis for providing rotational information to a tool lacking rotational data. For example, the linear approximation can be employed for selecting the best available rotational data with respect to step 730 of FIG. 7 discussed above. Furthermore, if rotational information for tool n−2 noted in FIG. 8 was to become unavailable, the rotational information could be inferred from the linear approximation shown in FIG. 9. For example, the line drawn as an approximation of the RPM's in FIG. 9 can be used to estimate the RPM at tool n−2. Such estimate can include averaging revolution speeds of the drill string. Such approximated value can then be sent to tool n−2 as needed. Further, rotational information of the tools on either side of tool n−2 could be sent to such tool.

Therefore, in FIG. 9, data representing various rotational characteristics can be sensed from a plurality of locations along the drill string, which is then transmitted and received at a controller (361). The controller (361) can then analyze this information to determine a corresponding rotational characteristic value, such as approximated RPM or average RPM, as shown in FIG. 9. The controller can then output data representative of the rotational characteristic value for use at a second location or broadcast it to a plurality of locations and tools along the drill string.

Figure 10:
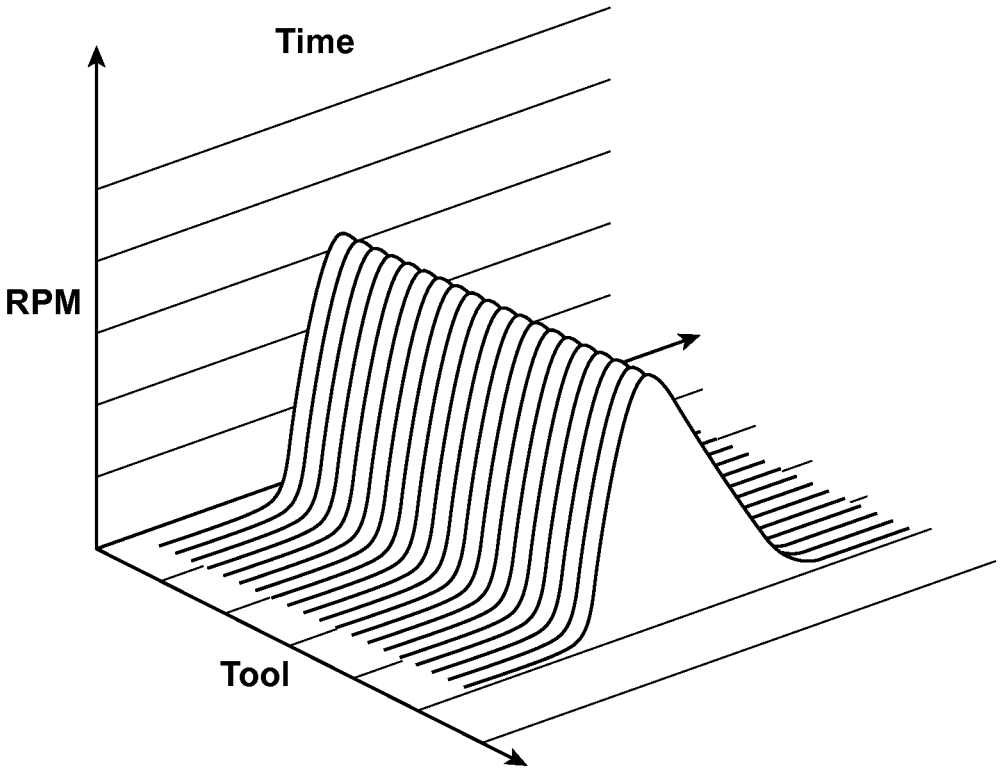
FIG. 10 is a graph illustrating RPM for a plurality of tools along the length of a drill string, over time, for analyzing rotational information of the drill string.

Whereas FIG. 9 can be taken to show an instantaneous RPM value for the tools, the rotational information can also be viewed dynamically over time as depicted in FIG. 10. Accordingly, FIG. 10, in addition to the RPM shown on the y-axis, and the tool number shown on the x-axis, can also include a z-axis for "time." Accordingly, the RPM data for each tool can be plotted over time thereby providing an Operator dynamic changes of the drill string rotation. Additionally, the rotational information such as RPM can be approximated along the length of the drill string over time which can be used by other tools or operations of the drill string. Additionally, in the same way discussed with respect to FIG. 9, the dynamic rotational information in FIG. 10 can serve as a basis for selecting the best available rotational data for step 730 in FIG. 7. Moreover, such data can be used for other operations or functions in the drill shaft. The operator is also able to determine the condition of the shaft along its length over specified time periods. For example, based on detected rotational characteristics and the time data in FIG. 10, a controller can determine acceleration values of the drill string. From such values, an operator or the controller can conduct analysis to determine the occurrence of drill string stick-slip conditions.

The use of remote tools and sensors or the retrieval of rotational information from multiple tools has many advantages, such as improving reliability by increasing the redundancy of sensors and rotational information. Moreover, the use of remote sensors and redundancy enables a subject tool to continue operation even in the absence of rotational information from local rotation sensors. Accordingly, even in the face of malfunction or absence of a sensor, drilling operations may be permitted to continue in full or limited mode for extended periods to complete a requested job, thereby saving time and money.

Moreover, with the use of remote sensors, the total number of sensors needed for a drill string can be reduced. For example, rather than providing a tool with a rotation sensor, such information can merely be provided based on remotely sensed information, thereby saving costs with respect to design and manufacture of tools.

Further, while this description has focused on rotation sensors and information, the disclosure is not so limited. Information other than, or in addition to rotational information (such as temperature and/or pressure) can be managed and made available for tools throughout the drill string system according to this disclosure.

The embodiments shown and described above are only examples. Therefore, many details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A method comprising:

receiving, at a controller, data representative of a first detected rotational characteristic of a drill string sensed at a first downhole location on the drill string;

calculating, at the controller, a second rotational characteristic corresponding to a second downhole location on the drill string based, at least in part, on the received data;

transmitting data representative of the calculated second rotational characteristic to a tool at the second downhole location, receiving, by the tool, the data representative of the calculated second rotational characteristic, and operating the tool at the second downhole location utilizing the received calculated second rotational characteristic corresponding to the second downhole location.

2. The method of claim 1, wherein:

calculating the second rotational characteristic comprises estimating an approximate rotational characteristic corresponding to the tool on the drill string based, at least in part, on the received data.

3. The method of claim 2, wherein estimating the approximate corresponding rotational characteristic for the tool on the drill string comprises estimating an approximate corresponding rotational characteristic for the entire drill string.

4. The method of claim 1, further comprising:

outputting, at the controller, data representative of the corresponding second rotational characteristic to the tool at the second downhole location on the drill string.

5. The method of claim 4, wherein receiving, at the controller, data representative of the detected first rotational characteristic of a drill string sensed at the first downhole location on the drill comprises receiving, at the controller, data representative of the detected first rotational characteristic of the drill string sensed at a plurality of downhole locations, including the first downhole location, on the drill string.

6. The method of claim 4, further comprising:

receiving at the tool at the second downhole location the outputted data on a communication channel and broadcasting the received data along the drill string on the communication channel for utilization at a plurality of downhole locations on the drill string, including the second downhole location.

7. The method of claim 6, wherein the communication channel is a communication bus extending along a length of the drill string and communicatively interconnecting a plurality of constituent tools of the drill string.

8. The method of claim 4, wherein the detected first rotational characteristic of the drill string sensed at the first downhole location on the drill string is revolution speed and the corresponding second rotational characteristic transmitted to the tools at the second downhole location on the drill string is a revolution speed value calculated from the detected revolution speed at the first downhole location.

9. The method of claim 8, wherein the revolution speed value at the tool at the second downhole location is calculated based on an estimated approximation using the detected revolution speed at the first downhole location.

10. The method of claim 9, wherein the estimated approximation is based on a linear extrapolation.

11. The method of claim 9, wherein the approximation is based on a curve which substantially fits a plurality of detected revolution speeds along the drill string, the plurality of detected revolution speeds including at least the detected revolution speed a the first downhole location.

12. The method of claim 9, wherein the approximation is based, at least in part, on the detected revolution speed at the first downhole location taken dynamically over time.

13. The method of claim 9 further comprising:

receiving, at the controller, data representative of detected revolution speeds of the drill string sensed at a plurality of downhole locations, including the first downhole location; and calculating, at the controller, a revolution speed value in dependence on the data representative of the detected revolution speeds sensed at the plurality of downhole locations for utilization at a plurality of downhole locations on the drill string, including the tool at the second downhole location.

14. The method of claim 13, wherein the calculation of the revolution speed value comprises averaging the detected revolution speeds sensed at the plurality of downhole locations and the result is the calculated revolution speed value.

15. The method of claim 4, wherein the corresponding rotational characteristic is an acceleration value calculated from a detected revolution speed.

16. The method of claim 15, determining the occurrence of drill string stick-slip conditions from analysis of acceleration values.

17. The method of claim 4, further comprising:

receiving the outputted data representative of the corresponding rotational characteristic value by the tool at the second downhole location, wherein the tool at the second downhole location is operationally dependent upon the received data representative of the corresponding rotational characteristic value.

18. The method of claim 17, further comprising:

generating the data received at the controller that is representative of the rotational characteristic of the drill string at the first downhole location on the drill string with a sensor positioned at the first downhole location on the drill string.

19. The method of claim 18, further comprising:

determining that the sensor that detects rotational characteristics of the drill string at the second tool is inoperative; and utilizing the output data representative of the corresponding rotational characteristic value by the tool at the second downhole location.

20. The method of claim 17, wherein the tool at the second downhole location is a rotary steerable subterranean drill.

21. The method of claim 17, wherein the tool at the second downhole location is a drilling shaft deflection device of a rotary steerable subterranean drill.

22. A drilling system comprising:

a subterranean drill string;

a plurality of rotational characteristic sensors arranged on the drill string;

a drill string communication system; and a controller, located at a first downhole location;

wherein the controller receives data representative of a detected first rotational characteristic of the drill string sensed by one of the plurality of rotational characteristic sensors at the first downhole location on the drill string, the controller calculates a second rotational characteristic corresponding to a second downhole location on the drill string, based, at least in part, on the detected data; and data representative of the calculated second rotational characteristic is received by a tool at the second downhole location, the received calculated second rotational characteristic used to operate the tool at the second downhole location.

23. The drilling system of claim 22, wherein the calculated second rotational characteristic is received by the tool at the second downhole location, wherein the tool at the second downhole location is operationally dependent upon the received data representative of the corresponding rotational characteristic value.

24. The drilling system of claim 23, wherein the tool at the second downhole location is a rotary steerable subterranean drill.

25. The drilling system of claim 24, wherein the tool at the second downhole location is a drilling shaft deflection device of a rotary steerable subterranean drill.

26. The drilling system of claim 25, wherein the drilling shaft deflection device further comprises:

a drilling shaft rotatably supported in a housing;

a drilling shaft deflection assembly comprising an outer eccentric ring and an inner eccentric ring that engages the drilling shaft; and a pair of drive motors anchored relative the housing and respectively coupled, one each, to the inner and outer eccentric rings for independently rotating each eccentric ring in either rotational direction.

27. The drilling system of claim 26, wherein the drilling shaft deflection device further comprises:

the housing being generally cylindrical and having a longitudinal centerline, the longitudinal centerlines of the drilling shaft and housing being substantially coincident when the drilling shaft is undeflected within the housing;

the drilling shaft deflection assembly contained within the housing;

the outer eccentric ring being rotatably supported at an inner peripheral surface of the housing and having a circular inner peripheral surface that is eccentric with respect to the housing;

the inner eccentric ring being rotatably supported at the circular inner peripheral surface of the outer eccentric ring and having a circular inner peripheral surface that engages the drilling shaft and which is eccentric with respect to the circular inner peripheral surface of the outer eccentric ring; and one of the pair of motors drivingly coupled by a first transmission to the outer eccentric ring and which rotates the outer eccentric ring in a first direction and an opposite, second direction relative to the housing and the other of the pair of motors drivingly coupled by a second transmission to the inner eccentric ring and which rotates the inner eccentric ring relative to the outer eccentric ring.

28. A method for sharing information between components of a subterranean drill string, the method comprising:

receiving, at a downhole controller, data representative of a detected first characteristic of a drill string; sensed at a first downhole location on the drill string; and calculating, at the controller, a corresponding second characteristic in dependence upon the received data representative of the detected first characteristic of the drill string sensed at the first downhole location on the drill string for utilization at a tool located at another downhole location than the first location on the drill string; and operating the tool using the second characteristic.

29. The method of claim 28, wherein the detected characteristic is chosen from the group comprising: (i) a rotational characteristic; (ii) a pressure characteristic; and (iii) a temperature characteristic.

* * * * *